United States Patent [19]

Masui

[11] Patent Number: 4,651,549

[45] Date of Patent: Mar. 24, 1987

[54] METHOD FOR CORRECTING ROLLED MATERIAL

[75] Inventor: Takeshi Masui, Hyogo, Japan

[73] Assignee: Sumitomo Metal Industries, Ltd., Osaka, Japan

[21] Appl. No.: 709,841

[22] Filed: Mar. 8, 1985

Related U.S. Application Data

[63] Continuation of Ser. No. 439,412, Nov. 5, 1982, abandoned.

[30] Foreign Application Priority Data

Nov. 13, 1981 [JP] Japan ..... 56-181776
Mar. 30, 1982 [JP] Japan ..... 57-53417

[51] Int. Cl.[4] ..... B21D 3/05; B21D 3/04; B21D 3/12; B21B 15/00

[52] U.S. Cl. ..... 72/161; 72/183; 72/205

[58] Field of Search ..... 72/160–165, 72/183, 366, 205

[56] References Cited

U.S. PATENT DOCUMENTS

| | | | |
|---|---|---|---|
| 1,815,578 | 7/1931 | O'Brien | 72/161 |
| 2,078,711 | 4/1937 | Hudson | 72/164 |
| 3,362,202 | 1/1968 | Gay | 72/161 |
| 3,777,532 | 12/1973 | Noé72 | 160/ |
| 3,839,888 | 10/1974 | Greenberger | 72/161 |
| 4,316,376 | 2/1982 | Masui et al. | 72/161 |
| 4,385,512 | 5/1983 | Matsumoto et al. | 72/366 |

FOREIGN PATENT DOCUMENTS

| | | | |
|---|---|---|---|
| 21807 | 6/1972 | Japan | 72/160 |
| 38734 | 9/1972 | Japan | 72/161 |
| 31666 | 3/1976 | Japan | 72/161 |
| 631081 | 10/1949 | United Kingdom | 72/161 |

*Primary Examiner*—Daniel C. Crane
*Attorney, Agent, or Firm*—Burns, Doane, Swecker & Mathis

[57] ABSTRACT

In a leveling line, the shape of a rolled material is corrected by applying a longitudinal tensile force to the material on the entrance or the exit side or both the sides of a roller leveler or within it, a warp of the material is corrected by applying a bending tension to the material within the roller leveler, and a camber of the material is corrected by applying a larger plastic elongation to either one of the widthwise edges of the material than to the other, on the entrance or the exit side or both the sides of the roller leveler or within it.

1 Claim, 12 Drawing Figures

METHOD FOR CORRECTING ROLLED MATERIAL

This application is a continuation of application Ser. No. 439,412, filed Nov. 5, 1982, abandoned.

BACKGROUND OF THE INVENTION

The present invention relates to a method for correcting out-of-flatness of a rolled material such as a steel strip and a sheet.

The out-of-flatness of a rolled material such as a steel strip as hot rolled may be classified roughly into shape defect and warp. The shape defect is due to a difference in longitudinal elongation of the material and cannot be corrected unless a plastic elongation is provided thereto.

Heretofore, a roller leveler has been used to correct a warp and to reduce a residual stress in the rolled material. A typical roller leveler heretofore used comprises a pair of pinch rolls disposed on the entrance side for the material and a plurality of leveler rolls disposed zigzag in succession to the pinch rolls. The pinch rolls are driven by a motor and the leveler rolls are driven simultaneously by another motor through a gear box. The pinch rolls and the leveler rolls may be driven commonly by the same motor.

The pinch rolls send the material into the leveler and are disposed, in a reciprocating leveler, on the entrance and exit side of the leveler rolls. The pinch rolls have a small load and the same material feed speed as the leveler rolls. Accordingly, it was impossible for the conventional pinch rolls to provide a plastic elongation to the material during leveling.

The leveler rolls are supported usually by several trains of back-up rolls and compensated for in deflection. The leveling intermesh (the quantity of relative setting of the upper and the lower rolls) can be established on the entrance and the exit sides independently from each other. Leveling is performed with tilting.

However, the conventional roller levelers have a low capacity for correcting shape defects since they are designed to correct warps (particularly, longitudinal warp) and to reduce residual stresses. In order to provide a plastic elongation to the material with the roller leveler, it is necessary to provide an axial force positively. The conventional roller leveler is not capable of providing the plastic elongation and is low in the capacity of correcting shape defects because it is only the residual stress in the material and the frictional force between the roll and the material that act as the axial force.

Further, in the rolled material such as a steel strip, a camber bending greatly in the longitudinal direction is produced. The principle of correction of the camber is to provide the material with a larger elongation in the curved inside than in the outside or to provide the material with a bending in the direction opposite to the camber by changing the direction of movement of the material. In the conventional roller leveler, however, it is impossible to change the curvatures of the inside and the outside of the material during leveling, since the leveler rolls are disposed at right angles to the longitudinal direction of the material and, accordingly, are not inclinable in the horizontal or vertical planes. Therefore, it is almost impossible in the conventional roller leveler to correct the camber during leveling.

SUMMARY OF THE INVENTION

An object of the present invention is to provide a method for correcting out-of-flatness and camber of a rolled material using a leveling line for the material.

The method according to the present invention comprises the steps, in a rolled material leveling line, of correcting the shape of the material by applying a longitudinal tensile force to the material on the entrance or the exit side of a roller leveler or within the roller leveler, correcting a warp of the material by applying a bending tension to the material within the roller leveler, and correcting a camber of the material by applying a larger plastic elongation to either one of the widthwise edges of the material than to the other, on the entrance or the exit side of the roller leveler or within the roller leveler.

In the step of correcting the shape of the material, the following means are taken:

(1) At least a pair of pinch rolls are disposed on the entrance side or the exit side or both the sides of the roller leveler and a difference is provided to the material feed speed between the leveler rolls and the pinch rolls, to thereby generate an axial force in the material;

(2) The leveler rolls are divided into two or more groups and a difference is provided to the circumferential speed of the leveler rolls between the groups, to thereby generate an axial force in the material. In this means, it is preferred that the leveler rolls of at least one group are undriven or the leveler rolls of the low circumferential speed or undriven group have a smaller diameter than that of the leveler rolls of the driven group.

In the step of correcting the warp of the material, a normal leveling is performed by common roller levelers or the roller levelers divided into groups as described above.

In the step of correcting the camber of the material, the following means are taken:

(1) At least one of the rolls of the common roller leveler is made inclinable in a horizontal plane or in a vertical plane or in both the planes, to thereby apply a larger plastic elongation to either one of the widthwise edges of the material than to the other;

(2) The leveler rolls of at least one group of the leveler rolls divided into groups as described above are made inclinable in a horizontal plane or in a vertical plane or in both the planes, to thereby apply a larger plastic elongation to either one of the widthwise edges of the material than to the other;

(3) At least a pair of the pinch rolls disposed on the entrance side or on the exit side or on both the sides are made inclinable in a horizontal plane or in a vertical plane or in both the planes, to thereby apply a larger plastic elongation to either one of the widthwise edges of the material than to the other;

(4) At least a pair of the pinch rolls disposed on the entrance side or on the exit side or on both the sides, and at least one of the rolls of the common roller leveler are made inclinable in horizontal planes or in vertical planes or in both the planes, to thereby apply a larger plastic elongation to either one of the widthwise edges of the material than to the other;

(5) At least a pair of the pinch rolls disposed on the entrance side or on the exit side or on both the sides of the roller leveler, and at least one group of the leveler rolls of the roller leveler whose leveler rolls are divided into groups as described above are made inclinable in horizontal planes or in vertical planes or in both the planes to thereby apply a larger plastic elongation to either one of the widthwise edges of the material than to the other.

BRIEF DESCRIPTION OF THE DRAWINGS

The invention will be better understood from the following description taken in connection with the accompanying drawings in which.

DESCRIPTION OF THE PREFERRED EMBODIMENTS

With reference now to the accompanying drawings, the preferred practices of the method according to the present invention will be described.

The description will be directed firstly to the step of correcting the shape of the rolled material by applying a longitudinal tensile force to the material.

Figure 1:
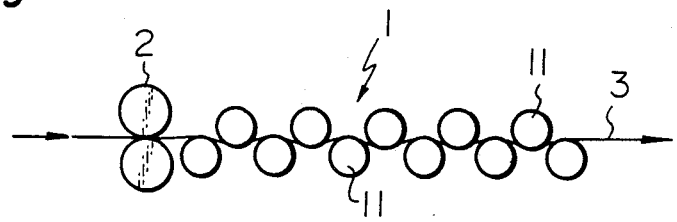
FIGS. 1 to 4 are schematic illustrations of leveling lines to which the method according to the present invention is applied.
Figure 1:
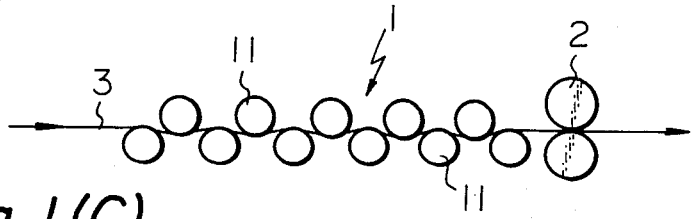
Figure 1:
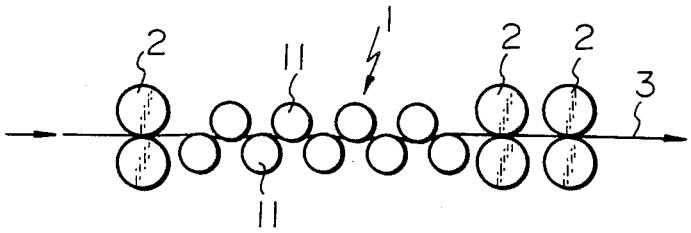

First of all, the means for generating an axial force in the rolled material using pinch rolls will be described with reference to FIGS. 1A to 1C, in which a common roller leveler 1 comprises a plurality of leveler rolls 11 arranged zigzag. At least a pair of pinch rolls 2 are disposed either on the entrance side (FIG. 1A) or on the exit side (FIG. 1B) or on both the sides (FIG. 1C) of the roller leveler 1. A rolled material 3 passes through the pinch rolls 2 and the roller leveler 1 in the direction of the arrows.

In the method according to the present invention, a plastic elongation is applied to the material 3 by providing such a strength as will increase the reduction load of the pinch rolls 2 and by making the circumferential speed of the pinch rolls 2 slower on the entrance side and faster on the exit side than the circumferential speed of the leveler rolls 11 to thereby apply a backward tension and/or a forward tension. In this case, assuming that the coefficient of friction between the pinch rolls 2 and the material 3 is 0.2, application of a reduction force five times greater than the applied tension is required. Accordingly, in the case where a pair of the pinch rolls are not sufficient, the axial force is applied by using a plurality of pairs of the pinch rolls 2 for reduction as shown in FIG. 1C and making the circumferential speed of the pinch rolls different from that of the leveler rolls.

Figure 2:
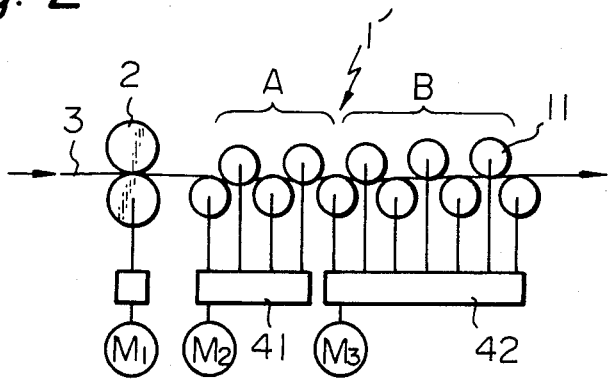

Referring now to FIG. 2, the means for generating the axial force in the rolled material 3 using the roller leveler 1 will be described. The roller leveler 1' used in this means is substantially identical in construction with the common leveler shown in FIG. 1. In the roller leveler 1', the leveler rolls 11 are divided into two groups A and B, which are driven by a motor $M_2$ and a gear box 41 and a motor $M_3$ and a gear box 42, respectively. Accordingly, the rolls of the group A are driven separately from the rolls of the group B.

In leveling, the circumferential speed of the rolls of the group A on the upstream side with respect to the direction of movement of the material is determined to be smaller than the circumferential speed of the rolls of the group B on the downstream side thereof. Preferably, the motor $M_2$ may be stopped to make all the rolls of the group A undriven.

It is further preferred that the diameter of the rolls which are lower in the circumferential speed or undriven is smaller than the diameter of the rolls which are higher in the circumferential speed. This is effective to provide a large bending and to produce a large axial force.

Figure 3:
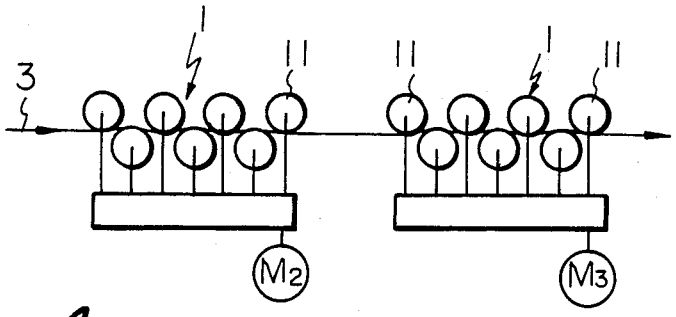
Figure 4:
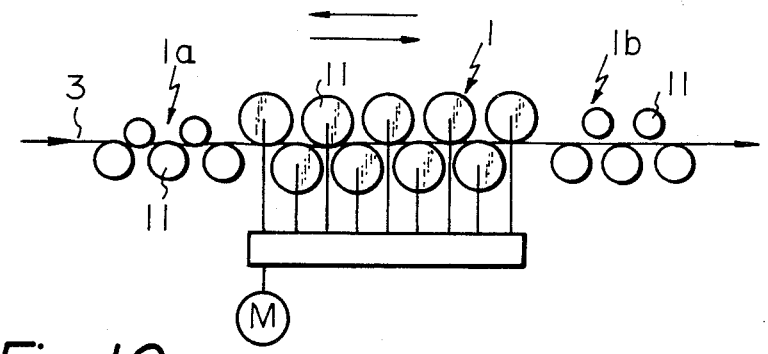

As modifications of the roller leveler for use in the method according to the present invention, two common roller levelers 1 having different circumferential speed of the rolls may be used as shown in FIG. 3 or undriven roller levelers **1*a* and 1*b* may be disposed on the entrance sides of a common reciprocating roller leveler 1 as shown in FIG. 4**.

In order to apply an axial force to the material to produce a plastic elongation therein, the material is drawn through the groups A and B as shown in FIG. 2 with the rolls of the group A on the upstream side of the roller leveler 1 driven at a lower speed than the group B or undriven at all. Table 1 shows the results of leveler drawing experiment performed as mentioned above.

TABLE 1

| Material | Intermesh (mm) | Drawing Force (kg/mm$^2$) | Plastic Elongation (%) | Shape Steepness (%) |
|---|---|---|---|---|
| (Starting | — | — | — | 2.35 |
| material | −2.0 | 0.24 | 0.1 | 0.42 |
| shape) | −1.75 | 0.34 | 0.14 | 0.32 |
| Center | −1.5 | 0.40 | 0.16 | 0.21 |
| Buckle | −1.0 | 0.56 | 0.24 | 0.20 |
| | 0 | 0.84 | 0.40 | 0 |
| (Starting | — | — | — | 3.08 |
| material | −2.5 | 0.1 | 0.06 | 1.20 |
| shape) | −2.0 | 0.22 | 0.16 | 0.63 |
| | −1.5 | 0.34 | 0.20 | 0.38 |
| Edge Wave | −1.0 | 0.51 | 0.24 | 0.09 |
| | 0 | 0.74 | 0.38 | 0 |

Figure 5:
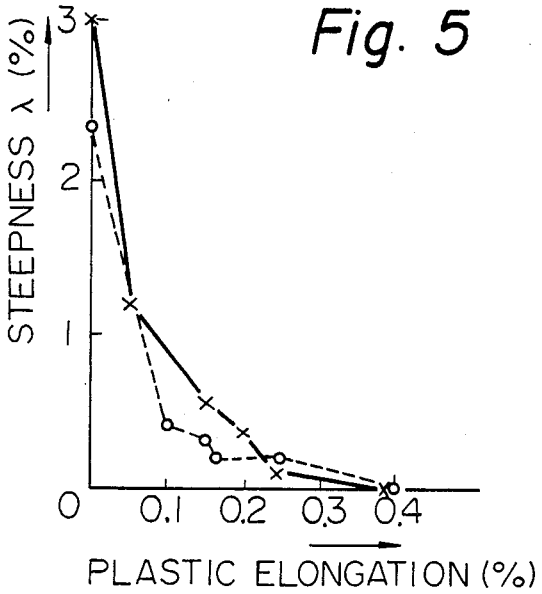
FIG. 5 is a graph showing the results of drawings tests of a material with the roller leveler to which the method according to the present invention is applied.

In this experiment, five pieces of leveler rolls of 50 mm diameter and an aluminum sheet of 3 mm thickness, 250 mm width and 1500 mm length were used. FIG. 5 graphically shows the results of this experiment. As shown in Table 1 and FIG. 5, the shape defects (steepness λ) of the material were corrected satisfactorily.

The step for correcting a warp of the material is performed by providing a bending under tension to the material with the roller levelers 1, 1' or **1*a*, 1*b*** described above. This step is publicly known and further description thereof will be unnecessary.

The step for correcting a camber of the material by applying a larger plastic elongation to either one of the widthwise edges of the material than to the other will now be described.

Figure 6:
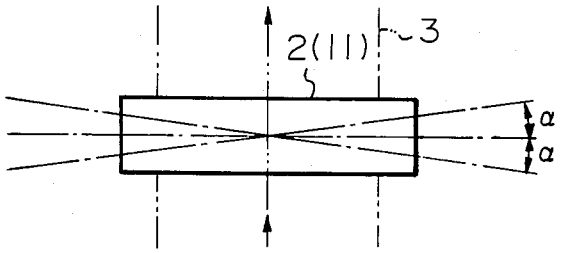
FIG. 6 is an illustration of the case in which a roll is inclined in a horizontal plane.

In order to perform this step, the roller leveler 1 is so constructed that the pinch rolls 2 or the leveler rolls 11 are inclinable in the horizontal plane or in the vertical plane or in both the planes. FIG. 6 shows the construction in which the pinch rolls 2 or the leveler rolls 11 are inclinable in the horizontal plane while FIG. 7 shows the construction in which the pinch rolls 2 or the leveler rolls 11 are inclinable in the vertical plane.

In a common roller leveler, at least one of the leveler rolls is made inclinable. In the case where the roller levelers are divided into groups as described hereinabove, it is simple in construction and most effective that all the leveler rolls of at least one of the groups are made inclinable. In the case where the pinch rolls are inclined, at least one pair of the pinch rolls are made inclinable. The roller leveler may take the construction in which the leveler rolls and the pinch rolls are inclinable simultaneously.

Figure 7:
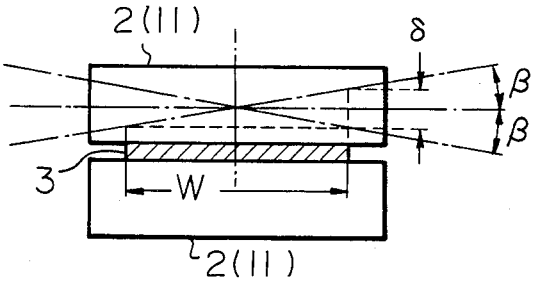
FIG. 7 is an illustration of the case in which a roll is inclined in a vertical plane.

For example, in the roller leveler 1' shown in FIG. 2, all the leveler rolls 11 of the group A are inclinable in the horizontal plane with an angle of inclination $\alpha$ (FIG. 6) and in the vertical plane with an angle of inclination $\beta$ (FIG. 7). Inclination of the rolls in the horizontal plane is performed preferably with each of the groups A and B, and inclination of the rolls in the vertical plane is performed preferably with the group A.

In the case where the rolls 11 in the vertical plane, the relationship between the angle of inclination $\beta$ and the difference in intermesh $\delta$ is expressed by the formula as shown in FIG. 7:

$$\delta = W \tan \beta$$

where W denotes the width of the material 3.

Figure 8:
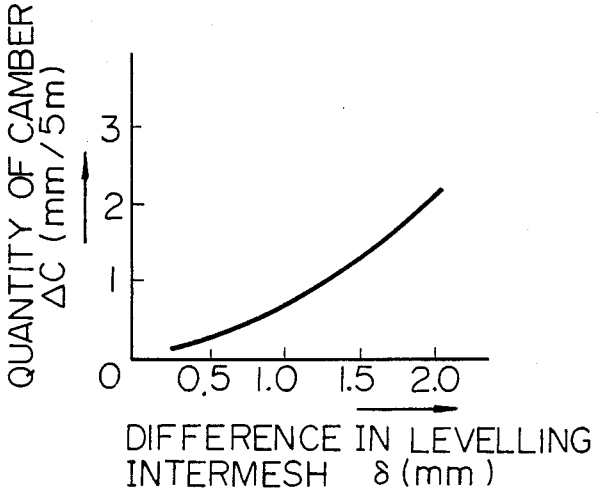
FIGS. 8 and 9 are graphs showing the relationship of the quantity of camber with the difference in leveling intermesh and the quantity of inclination, respectively, of the leveler roll.

Correction of the camber of the rolled material is performed by, as described above, inclining the leveler roll in the horizontal plane or in the vertical plane or in both the planes. FIG. 8 shows the results of experiments in which the leveler rolls (11 pieces, each of 50 mm in diameter) were inclined in the vertical plane. The difference in intermesh $\delta$ (mm) of FIG. 8 corresponds to the angle of inclination $\beta$ (degree) of FIG. 7 as described above.

Figure 9:
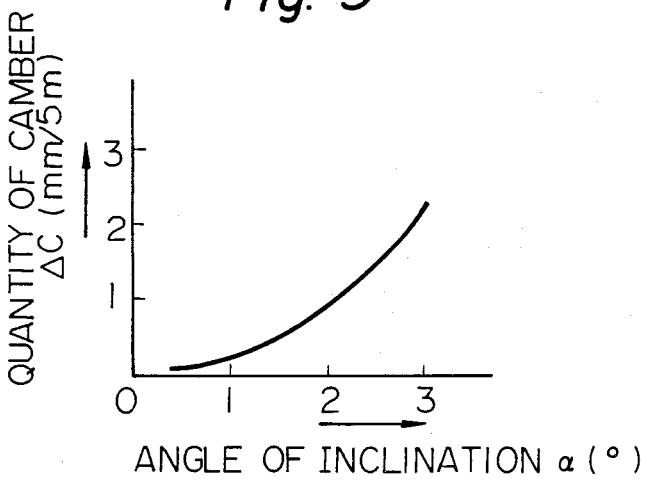

FIG. 9 shows the results of experiments using two sets of the roller levelers 1 of FIG. 3 each comprising 7 pieces of the leveler rolls 11 of 60 mm in diameter, in which the leveler rolls 11 were inclined in the horizontal plane. As seen from FIG. 9, a quantity of camber $\Delta C$ increases as the angle of inclination $\alpha$ of the roller 11 in the horizontal plane increases. In this case, the quantity of camber $\Delta C$ is defined as the maximum quantity of bend of the material which is 5 m in length.

Accordingly, effecitve correction of camber is made possible by inclining the leveler rolls in the horizontal plane or in the vertical plane.

Now, several examples of application of the method according to the present invention to actual leveling line will be described.

EXAMPLE 1

The roller leveler 1 having an inclining means and comprising 11 pieces of leveler rolls of 50 mm in diameter was used. The pinch rolls 2 for applying axial force and having the inclining means were disposed on the entrance side and on the exit side of the roller leveler 1. An aluminum sheet of the size 3 mm thickness × 300 mm width × 4000 mm length was leveled with the difference in speed of −0.1% between the entrance side pinch rolls 2 and the difference in speed of +0.1% at the exit side pinch rolls 2, resulting in that a plastic elongation of 0.12% was obtained, that is the flatness was considerably improved.

Thereafter, leveling was performed under the same conditions as above with the difference in intermesh $\delta$ of 1.5 mm between the left and the right sides of the leveler rolls 11, resulting in a camber of 1.2 mm/4 m. Succeedingly, the material was leveled with the leveler rolls 11 inclined in the horizontal plane by two degrees ($\alpha = 2°$), a camber of 1.5 mm/4 m was resulted. When this material was leveled again with the difference $\delta$ in intermesh between the left and the right sides of the leveler rolls of 1.5 mm, the camber was almost corrected.

On the other hand, when the material with the camber of 1.2 mm/4 m was leveled with the leveler rolls 11 inclined in the horizontal plane by 1.5 degrees ($\alpha = 1.5°$), a camber of 0.7 mm/4 m was resulted. When this material was further leveled again with the difference $\delta$ in intermesh between the left and the right sides of the leveler rolls of 1.0 mm, the camber was almost corrected.

EXAMPLE 2

An aluminum sheet of a satisfactory flatness obtained by leveling using the same equipment and under the same conditions as in Example 1 above for providing a plastic elongation Was leveled thereby with the leveler rolls unchanged and the pinch rolls on the exit side inclined by 1.5 degrees in the horizontal plane ($\alpha = 1.5°$), resulting in that a camber of 0.8 mm/4 m was produced. When this material was leveled with the pinch rolls inclined by 1.8 degrees in the opposite direction in the horizontal plane ($\alpha = 1.8°$), the camber was almost corrected.

When the material with the camber 0.8 mm/4 m was leveled with the pinch rolls 2 on the exit side inclined by two degrees in the vertical plane ($\beta = 2°$), the camber was almost corrected in this case also.

EXAMPLE 3

An aluminum sheet of a satisfactory flatness obtained by leveling using the same equipment and under the same conditions as in Example 1 above for providing a plastic elongation was leveled thereby with the difference in intermesh $\delta$ between the left and the right sides of the leveler rolls of 1.0 mm and with the difference in intermesh $\delta$ between the left and the right sides of the pinch rolls 2 of 1.0 mm, resulting in a camber of 1.5 mm/4 m. When this material was leveled again with the difference in intermesh $\delta$ between the left and the right sides of the leveler rolls of 1.3 mm and with the difference in intermesh $\delta$ between the left and the right sides of the pinch rolls of 1.2 mm, the camber was almost corrected.

EXAMPLE 4

Leveling of an aluminum plate was performed by the roller leveler 1' of the construction shown in FIG. 2, using 11 pieces of leveler rolls 11 of the diameter of 50 mm.

At the beginning of the leveling of the plate, all the leveler rolls 11 were driven. At the time the leading end of the plate reached the middle of the leveler group B, the motor $M_2$ driving the rolls 11 of the leveler group A on the upstream side with respect to the direction of movement of the material was stopped. As the result, a plastic elongation of 0.15% in the longitudinal direction of the plate was produced, whereby the shape of the plate was corrected considerably.

EXAMPLE 5

In the roller leveler of Example 4, the rolls 11 of the Group A on the upstream side were established to have the difference in intermesh δ of 1 mm in the vertical plane and the angle of inclination α of 1.0 degree in the horizontal plane.

In the leveling with the arrangement described above, a quantity of camber ΔC of 3 mm/5 m was produced. Then, when the material with the above-defined camber was leveled again with the difference in intermesh δ and the angle of inclination α in the same quantity as and in the opposite direction to the previous leveling, the camber defined above was corrected.

EXAMPLE 6

In the roller leveler 1 of the construction shown in FIG. 4, leveling of an aluminum plate of the size 4 mm thickness×300 mm width×4000 mm length was performed using the roller leveler 1 comprising nine pieces of leveler rolls of diameter of 70 mm and the undriven levelers 1*a* and 1*b* disposed on the entrance and on the exit sides of the roller leveler 1 and comprising two upper rolls of diameter of 30 mm and three lower rolls of diameter of 50 mm.

The plate was passed first to the right in FIG. 4 and strongly pressed by the leveler 1*a* at the time it reached the middle portion of the roller leveler 1. Then, a 0.3% elongation was observed in the plate while no elongation was observed without the use of the leveler 1*a*.

Thereafter, the plate was passed through the leveler to the left with the strong pressing of the leveler 1*b* and inclination of the rolls by 1.5° in the horizontal plane, then a camber occurred in the plate.

In order to correct the camber, the plate was passed through the leveler to the right with a difference in intermesh δ of 1.5 mm applied to the leveler 1*a*, then the camber of the plate was almost eliminated.

Then, the plate was formed artificially therein with center buckles and edge waves of steepness λ of 3% by a separate rolling line, and was leveled by strongly pressing it by the leveler 1*a* and drawing it through the leveler. Then, both the center buckles and the edge waves were eliminated.

Effective feeding of the material was obtained by the pinch rolls disposed between the levelers 1 and 1*a* or between the levelers 1 and 1*b*.

EXAMPLE 7

In the roller leveler 1 of the construction shown in FIG. 3, leveling of a lead plate of the size 4 mm thickness×300 mm width×5000 mm length was performed using seven rolls of the diameter of 60 mm.

Both the levelers 1 were stopped with the plate bitten into by the levelers 1. Thereafter, the rolls of the leveler 1 on the downstream side were inclined by three degrees in the horizontal plane to forcibly give a camber to the plate. Further, it was confirmed that, when the angle of inclination α became zero degrees, it was possible to pull the plate to give it an elongation, that is, it was possible to use the leveler as a chuck means for giving an elongation to the plate.

Thereafter, leveling was performed while applying a tensile force to the plate by making the circumferential speed of the rolls of the leveler 1 on the upstream side greater than the circumferential speed of the rolls of the leveler 1 on the downstream side. Then, an elongation of 0.5% was obtained.

EXAMPLE 8

Figure 10:
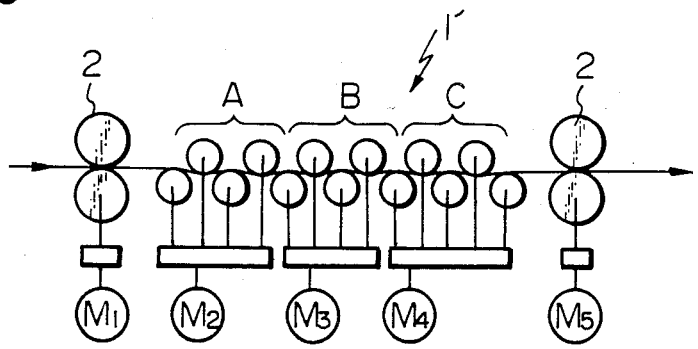
FIG. 10 is a schematic illustration of a leveling line to which the method according to the present invention is applied.

As shown in FIG. 10, the leveler 1' comprising 13 pieces of rolls of the diameter of 100 mm was divided into three groups A, B and C, and the motor $M_2$ was ON-OFF controlled while the motors $M_3$ and $M_4$ were controlled with a difference in the circumferential speed. In leveling an aluminum plate of the size 4 mm thickness×500 mm width×5000 mm length by the leveler of the above-described construction, at the time the leading end of the plate left the middle portion of the leveler group B, the motor of the leveler group A was switched off and the circumferential speed of the leveler group C was made 1.5% higher than that of the leveler group B. Then, a 1% elongation of the plate was confirmed.

Thereafter, when the levelers of the groups A and C were inclined by two degrees in the horizontal plane with all the other conditions remaining unchanged, a camber of 5 mm/5 m was produced.

Further, in the case where the leveler groups A, B and C were rotated in the same speed during leveling, it was confirmed that small intermesh produced no plastic elongation at all and increased intermesh produced a plastic elongation of 0.05% at most.

As described above, the method for leveling a rolled material according to the present invention is, when applied to hot materials such as plates and hot rolled materials, particularly effective in correction of out-of-flatness and camber, to thereby increase yield rate. Further, the method according to the present invention has made it possible to correct high strength materials, which was heretofore impossible, and, accordingly, provides considerable meritorious effects in correction of steel strip.

While we have described and illustrated a present preferred method of practising the invention, it is to be distinctly understood that the invention is not limited thereto but may be otherwise variously practised within the scope of the following claims.

What is claimed is:

1. A method for correcting the shape, camber, and warp of a rolled material comprising the steps, in a rolled material leveling line including a roller leveler, of:

dividing a plurality of leveler rolls which constitutes said roller leveler into two or more groups;

feeding the material through said leveler rolls so that the material moves through an undulating path in each group of leveler rolls;

correcting the shape of the material by driving one of the groups of rollers and rendering another of the groups of rollers undriven so that a longitudinal tensile force is applied to the material to cause a plastic elongation in the longitudinal direction of the material;

providing the leveler rolls of the undriven group with a smaller diameter than the leveler rolls of the driven group;

supporting at least one of said rolls of said roller leveler at an incline in a horizontal plane or in a vertical plane or in both planes;

correcting a camber of the material by applying a larger plastic elongation to one widthwise edge of the material than to the other widthwise edge by inclining said roll or rolls at a predetermined angle in the horizontal plane or in the vertical plane or in both of the planes; and correcting a warp of the material by applying a bending under tension to the material in the longitudinal direction of the material within the roller leveler to reduce residual stresses in the material.

* * * * *